US005162184A

United States Patent [19]

Aizawa

[11] Patent Number: 5,162,184

[45] Date of Patent: Nov. 10, 1992

[54] ELECTROPHOTOGRAPHIC PHOTORECEPTOR

[75] Inventor: Koichi Aizawa, Yokosuka, Japan

[73] Assignee: Fuji Electric Co., Ltd., Japan

[21] Appl. No.: 391,171

[22] Filed: Aug. 9, 1989

[30] Foreign Application Priority Data

Aug. 11, 1988 [JP] Japan ..... 63-200887

[51] Int. Cl.[5] ..... G03G 5/047

[52] U.S. Cl. ..... 430/59; 430/96; 430/67

[58] Field of Search ..... 430/58, 59, 96

[56] References Cited

U.S. PATENT DOCUMENTS

| | | | |
|---|---|---|---|
| 3,484,237 | 12/1969 | Shattuck et al. | 430/80 |
| 3,898,084 | 8/1975 | Champ et al. | 430/58 X |
| 4,278,747 | 7/1981 | Murayama et al. | 430/59 X |
| 4,632,892 | 12/1986 | Yashiki et al. | 430/59 X |

*Primary Examiner*—Roland Martin

*Attorney, Agent, or Firm*—Brumbaugh, Graves, Donohue & Raymond

[57] ABSTRACT

An electrophotographic photoreceptor comprising a charge transport layer, a charge generation layer and a surface protection layer sequentially laminated on a conductive substrate wherein the binder of the charge transport layer is a resin having a molecular weight of not less than 20,000 and not more than 45,000.

2 Claims, 1 Drawing Sheet

ELECTROPHOTOGRAPHIC PHOTORECEPTOR

BACKGROUND OF THE INVENTION

The present invention relates to an electrophotographic photoreceptor composed of a charge transport layer, a charge generation layer and a surface protection layer sequentially laminated on a conductive substrate wherein the charge transport layer comprises a resin binder having a molecular weight at less than 20,000 and not more than 45,000.

As a photoconductive material for an electrophotographic photoreceptor (hereinunder referred to as "photoreceptor"), an inorganic photoconductive material such as selenium and a selenium alloy, an inorganic photoconductive material such as zinc oxide and cadmium sulfide dispersed in a resin binder, an organic photoconductive material such as poly-N-vinyl carbazole and polyvinyl anthracene, an organic photoconductive material such as a phthalocyanine compound and a bisazo compound dispersed or vacuum deposited in a resin binder has conventionally been used.

A photoreceptor is required to have the ability to accept the surface charges while in a dark environment, the ability to generate charges when exposed to light and the ability to transport the generated charges. A single-layer type photoreceptor has a single layer which has these functions together. A laminated photoreceptor has a lamination of layers having separated functions, namely, a layer mainly contributing to generation of charges and a layer contributing to accepting of the surface charges in the dark place and transportation of charges at the time of receiving light.

In order to form an image by electrophotography using these photoreceptors, a Carlson system copier, for example, may be used. In this system, an image is formed by charging a photoreceptor by corona discharge in the dark, and exposing the surface of the charged photoreceptor to light so as to form an electrostatic latent image of the letters, pictures, etc. of the material to be copied, developing the electrostatic latent image with toner, and fixing the developed toner image on a base such as paper. In the photoreceptor after transferring the toner image, static charges are eliminated, and the remaining toner is removed and discharged by light for the reuse of the photoreceptor.

Electrophotographic photoreceptors using an organic material have recently been put to practical use due to the merits of plasticity, thermal stability, film forming properties and the like. For example, disclosed are photoreceptors composed of poly-N-vinyl carbazole and 2,4,7-trinitrofluorene-9-one (U.S. Pat. No. 3,484,237), photoreceptors containing an organic pigment as the main ingredient (Japanese Patent Laid-Open No. 37543/1972) and photoreceptors containing a eutectic complex consisting of a dye and a resin (Japanese Patent Laid-Open No. 10735/1972).

Organic materials have many merits which inorganic materials do not have, but all the properties electrophotographic photoreceptors are required to have are not satisfied in the present state of art. Particularly, a positive charging type photoreceptor composed of a conductive substrate, a charge transport layer, a charge generation layer and a surface protection layer laminated in that order has problems in charging capacity and charge holding capacity. More specifically, since holes run more easily than electrons in many charge transport layers, the charging capacity and the charge holding capacity of a positive charging type photoreceptor are lower than those of a negative charging type photoreceptor.

It is an object of the present invention to eliminate the above-described problems in the prior art and to provide a positive charging type electrophotographic photoreceptor having excellent charging capacity and charge holding capacity.

SUMMARY OF THE INVENTION

The present invention provides an electrophotographic photoreceptor composed of a charge transport layer, a charge generation layer and a surface protection layer sequentially laminated on a conductive substrate wherein the charge transport layer comprises a resin binder having a molecular weight of not less than 20,000 and not more than 45,000.

DETAILED DESCRIPTION OF THE INVENTION

As a result of studies on various organic materials so as to achieve this aim, the present inventor has found that the use of a resin having the above-described molecular weight as the binder of the transport layer greatly enhances the charging capacity and the charge holding ratio of a positive charging type photoreceptor, and has obtained a photoreceptor having excellent characteristics.

Figure 1:
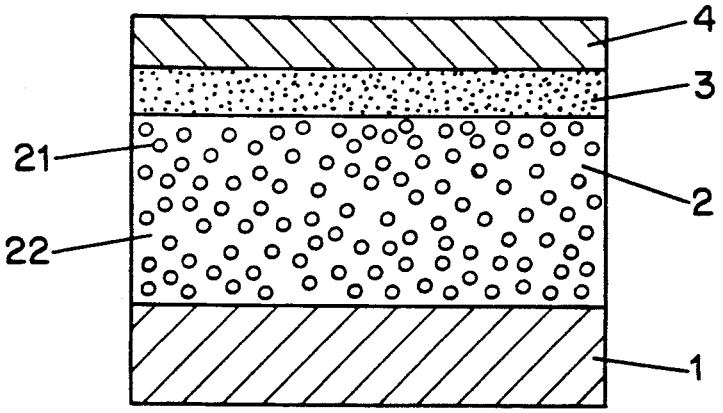
FIG. 1 is a schematic sectional view of an embodiment of a photoreceptor according to the present invention.

A photoreceptor of the present invention has a structure shown in FIG. 1. FIG. 1 is a schematic sectional view, and the reference numeral 1 represents a conductive substrate, 2 a charge transport layer, 3 a charge generation layer and 4 a surface protection layer. The charge transport layer 2 comprises a charge transporting material 21 and a binder 22.

The photoreceptor shown in FIG. 1 is produced by applying a solution of the conductive substrate, drying it and vacuum evaporating a charge generating material thereon, or by applying a dispersion obtained by dispersing the particles of the charge generating material in a solvent or a resin binder, drying it and further forming a coating layer thereon.

The conductive substrate 1 serves as the electrode of a photoreceptor and the base of each layer. The configuration of the conductive substrate 1 may be any of a cylinder, a plate and film, and the material thereof is a metal such as aluminum, stainless steel and nickel. Alternatively, glass, a resin, etc. which are subjected to conductive treatment may be used.

The charge generation layer 3 is produced by applying a material obtained by dispersing the particles of the charge generating material in a resin binder or by vacuum evaporation or the like, and generates charge when it receives light. It is important for the charge generation layer not only to have a high charge generation efficiency but also to pour the charges produced to the charge transport layer 2 and the surface protection layer 4 with efficiency. The electric field dependence of the charge generation layer is therefore preferably low so that it can pour charges even in a low electric field. As the charge generating material, for example, phthalocyanine compounds such as metal-free phthalocyanine and titanyl phthalocyanine, various azo, quinone and indigo pigments, dyes such as cyanine, squalilium, azulene and pyrylium compounds, selenium and selenium compounds are usable. It is possible to select an appropriate charge generating material in accordance with the wavelength range of the light of the exposure light source which is used for image formation. The charge generation layer is only required to have a charge generating function, and the thickness thereof is determined by the light-absorbing coefficient of the charge generating material. It is generally not more than 5 μm, preferably not more than 1 μm. The charge generation layer is mainly composed of a charge generating materials and a charge transporting material may be added thereto for use. As the resin binder, it is possible to use an appropriate combination of polycarbonate, polyester, polyamide, polyurethane, epoxy and silicone resins, and the polymers and the copolymers of methacrylic esters.

It is necessary that the surface protection layer 4 has as function of receiving and holding the charges of corona discharge and a capacity of transmitting the light to which the charge generating layer responds and a function of transmitting light, introducing it to the charge generation layer and neutralizing and quenching the surface charges by receiving the charges produced during exposure. As the coating material, organic insulating film forming material such as polyester and polyamide are usable. It is also possible to use a mixture of these organic materials and inorganic materials such as glass resin and $SiO_2$, and a material which reduces electric resistance such as a metal and a metal oxide. The coating materials are not restricted to organic insulating film forming materials, and inorganic materials such as $SiO_2$ and metals and metal oxides may be formed by a method such as deposition and sputtering. As described above, the coating materials are preferably as transparent as possible in the wavelength range in which the absorption of light by the charge generating material is maximum.

The thickness of the surface protection layer itself depends upon the composition of the surface protection layer but can be set as desired in a range in which no deleterious influence is produced such as increase in residual potential at the time of repetitive continuous use.

The charge transport layer 2 is a coating film consisting of a resin binder with a hydrazone compound represented by the following structural formula (I) dispersed therein as a charge transporting material:

(I.)

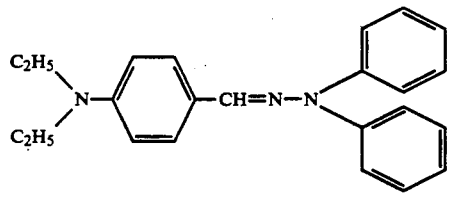

The charge transport layer 2 has a function of holding the charges of a photoreceptor in a dark place as an insulant layer and transporting the charges poured from the charge producing layer when light is received. It is known that as the resin binder, it is possible to use polycarbonate, polyester, polyamide, polyurethane, epoxy and silicone resins, the polymers and the copolymers of methacrylic esters, etc., but no attempt has been made on investigating various binders with the respective molecular weights as the parameters. According to the present inventor, the resin binder used for the charge transport layer has a close relation with the charging capacity and the charge holding capacity of the photoreceptor and a resin having a molecular weight of not less than 20,000 and not more than 45,000 is suitable as the resin binder in order to obtain a photoreceptor having excellent electrophotographic characteristics.

EXAMPLES

The invention will now be described in detail with respect to specific preferred embodiment thereof, it being understood that these examples are intended to be illustrative only and that the invention is not intended to be limited thereby.

EXAMPLE 1

Samples Nos. 1 to 12 were produced by providing a charge transport layer on an Al substrate while using a hydrazone compound represented by the structural formula (I) as a charge transporting material and various resin binders shown in Table 1 as the resin binder. The mixing ratio of the charge transporting material and the resin binder was about 1:1 by weight ratio.

TABLE 1

| Sample No. | Charge transporting material | Resin binder | Molecular weight of resin binder ($\times 10^3$) |
|---|---|---|---|
| 01 | Hydrazone compound represented by the formula (I) | Polyester Bylon 600 (produced by Toyobo) | 9 to 12 |
| 02 | Hydrazone compound represented by the formula (I) | Polyester Bylon 200 (produced by Toyobo) | 15 to 20 |
| 03 | Hydrazone compound represented by the formula (I) | Polycarbonate Panlite L-1225 (produced by Teijin Chemicals, Ltd.) | 22.5 |
| 04 | Hydrazone compound represented by the formula (I) | Polyester Bylon 500 (produced by Toyobo) | 20 to 25 |
| 05 | Hydrazone compound represented by the formula (I) | Polycarbonate Panlite L-1250 (produced by Teijin Chemicals, Ltd.) | 25 |
| 06 | Hydrazone compound represented by the formula (I) | Polycarbonate Panlite K-1285 (produced by Teijin Chemicals, Ltd.) | 28.5 |

TABLE 1-continued

| Sample No. | Charge transporting material | Resin binder | Molecular weight of resin binder (× $10^3$) |
|---|---|---|---|
| 07 | Hydrazone compound represented by the formula (I) | Polycarbonate Panlite K-1300W (produced by Teijin Chemicals, Ltd.) | 30 |
| 08 | Hydrazone compound represented by the formula (I) | Polycarbonate Panlite C-1400 (produced by Teijin Chemicals, Ltd.) | 40 |
| 09 | Hydrazone compound represented by the formula (I) | Panlite C-1400 (91.7 wt %) + PMMA reagent (8.3 wt %) | 45 |
| 10 | Hydrazone compound represented by the formula (I) | Panlite C-1400 (83.3 wt %) + PMMA reagent (16.7 wt %) | 50 |
| 11 | Hydrazone compound represented by the formula (I) | Panlite C-1400 (50 wt %) + | 70 |
| 12 | Hydrazone compound represented by the formula (I) | PMMA reagent | 100 |

Figure 2:
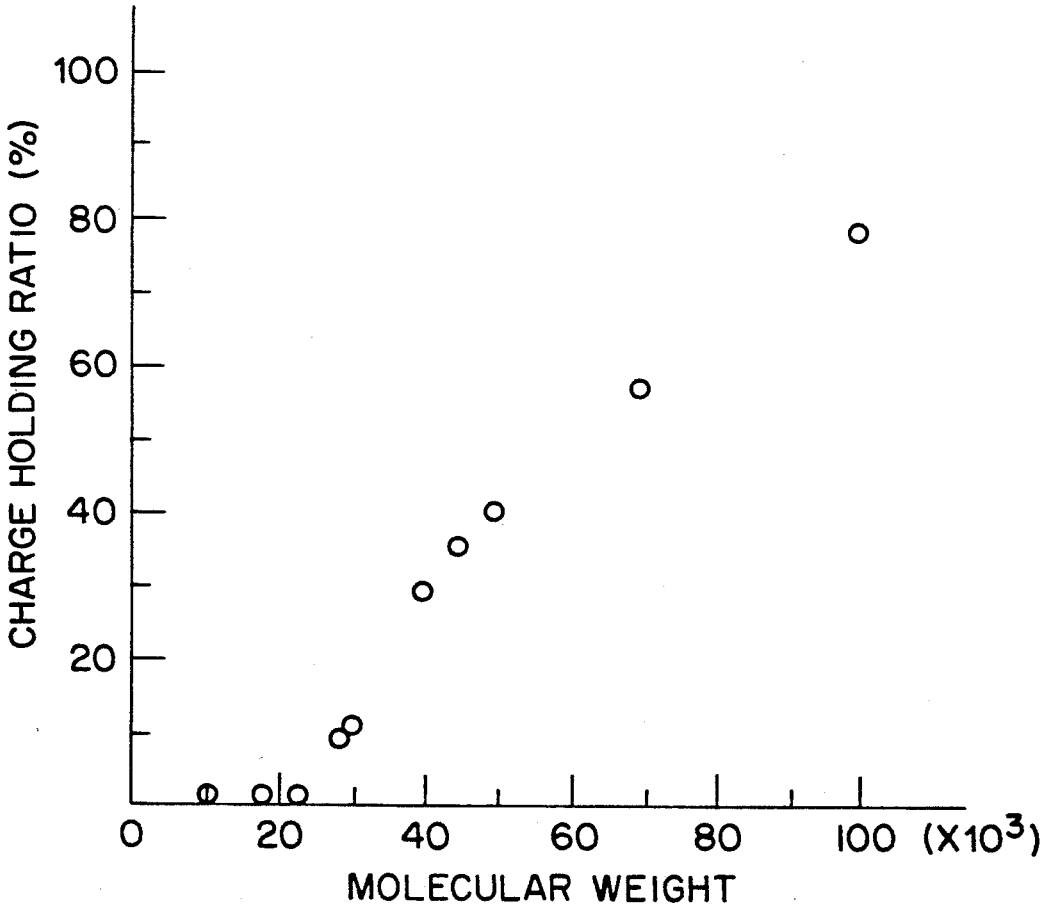
FIG. 2 is as graph showing the relationship between the molecular weight of the resin binder used for the charge transport layer and the charge holding ratio.

The positive charge holding ratios of these samples were measured after 5 minutes. It is clear from the graph in FIG. 2 that as the molecular weight of the resin binder increases, the charge holding ratio rapidly increases.

EXAMPLE 2

50 parts by weight of metal-free phthalocyanine, 50 parts by weight of polyester resin (Bylon: trade name, produced by Toyobo) and 50 parts by weight of PMMA were kneaded with a TFF solvent for 3 hours by a mixer to prepare a coating liquid. The coating liquid was applied to the charge transport layer of each sample produced in the same way as the samples Nos. 1 to 12 by a wire bar method so as to form a charge generation layer of 1 μm thick after drying. Comb type nitrogen-containing graft polymer (LF-40, produced by Soken Chemical Co., Ltd.) was applied to the charge generation layer so as to produce a surface protection layer of 0.5 μm thick after drying.

The electrophotographic characteristics of the photoreceptors Nos. 1 to 4 and Nos. 6 to 12 were measured by an electrostatic recording paper testing machine SP-428, produced by Kawaguchi Denki.

The surface potential Vs (volts) of the photoreceptor was the initial surface potential measured when the surface of the photoreceptor was positively charged by 10-second corona discharge at 6.0 KV in a dark place. The surface potential Vd (volts) of the photoreceptor held 2 seconds in the dark after the corona discharge was stopped was then measured. Thereafter, the surface of the photoreceptor was irradiated with white light of an illuminance of 2 1x and the time elapsed until Vd was reduced to ½ was obtained as the halved exposure $E_{\frac{1}{2}}$ (1x/sec.). The surface potential of the photoreceptor after 10-sec irradiation of white light of an illuminance of 2 1x was obtained as the residual potential Vr (volt). Since a high sensitivity by long-wavelength light is expected when a phthalocyanine compound is used as the charge generation material, the electrophotographic characteristics were also measured by using monochromatic light having a wavelength of 780 nm. The methods of measuring Vs and Vd were the same as above. Thereafter, the surface of the photoreceptor was irradiated with monochromatic light (780 nm) of 1 μW in place of the white light and the halved attenuation exposure $E_{\frac{1}{2}}$ (μJ/cm$_2$) was obtained. The surface potential of the photoreceptor after 10-sec irradiation of the monochromatic light was obtained as the residual potential Vr (volt). Out of the results of these measurements, the results measured with the monochromatic light (780 nm) of 1 μW are shown in Table 2.

TABLE 2

| Sample No. | Molecular weight (× $10^3$) | Vs (volts) | Vr (volts) | $E_{\frac{1}{2}}$ (μJ/cm$^2$) |
|---|---|---|---|---|
| 1 | 10 | 350 | 0 | — |
| 2 | 18 | 480 | 10 | — |
| 3 | 22.5 | 600 | 40 | 0.51 |
| 4 | 25 | 610 | 45 | 0.52 |
| 6 | 28.5 | 620 | 50 | 0.54 |
| 7 | 30 | 625 | 50 | 0.56 |
| 8 | 40 | 630 | 60 | 0.58 |
| 9 | 45 | 640 | 80 | 0.89 |
| 10 | 50 | 660 | 120 | 1.01 |
| 11 | 70 | 700 | 250 | 1.80 |

As is clear from Table 2, when the molecular weight of the resin binder used for the charge transport layer is about 20,000 or less, the surface potential Vs is low, and when it is about 45,000 or more, the residual potential Vr is low and the halved exposure $E_{\frac{1}{2}}$ is large (in other words, the sensitivity is low). Thus, neither case is suitable for practical use.

EXAMPLE 3

The photoreceptors in Example 2 which had been left to stand for 48 hours in an atmosphere of 100° C. were mounted on an electrophotographic apparatus to form images and the images were compared with those obtained by using the respective photoreceptors before standing. The results by the kinds of the resin binder are shown in Table 3.

TABLE 3

| Sample of resin binder | 48-hour standing in 100° C. atmosphere | |
|---|---|---|
| | Before | After |
| Polyester (Photoreceptors No. 1, 2, 4) | 0 (only No. 4) | x |
| Polycarbonate (Photoreceptors No. 3, 5, 6, 7, 8) | 0 | 0 |
| PMMA (Photoreceptor No. 12) | 0 | 0 |

In Table 3, the mark 0 indicates that the image obtained had a good quality was obtained, 0 that the image obtained had no problem in practical use, and x that the image obtained had a problem in practical use.

It is clear from table 3 that polycarbonate has excellent thermal stability. Accordingly, when polycarbonate is used as the resin binder for the charge transportation layer, it is possible to obtain a positive charge type photoreceptor excellent in charging capacity, charge holding capacity and thermal stability.

According to the present invention, in a photoreceptor comprising a charge transport layer, a charge generation layer and a surface protection layer sequentially laminated on a conductive substrate wherein a resin having a molecular weight of not less than 20,000 and not more than 45,000 is used as the binder for the charge transportation layer. The use of a resin binder makes a positive charge type photoreceptor excellent in charging capacity, charge holding capacity and thermal stability.

I claim:

1. An electrophotographic photoreceptor comprising a charge transport layer comprising a hydrazone compound represented by the following structural formula (I):

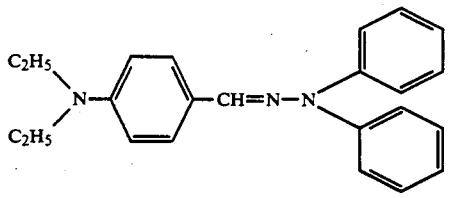

(I.)

metal-free phthalocyanine charge generation layer and a surface protection layer sequentially laminated on a conductive substrate, wherein the charge transport layer comprises a resin binder having a molecular weight of not less than 22,500 and not more than 40,000 selected from the group consisting of polycarbonate, polyester, and mixtures of polycarbonate and polymethylmethacrylate.

2. The electrophotographic photoreceptor according to claim 1, wherein the mixing ratio of the charge transporting material and the resin is about 1:1 by weight.

* * * * *